US008020413B2

(12) United States Patent
Yoo et al.

(10) Patent No.: US 8,020,413 B2
(45) **Date of Patent: *Sep. 20, 2011**

(54) FOREIGN MATERIALS FILTERING APPARATUS AND WASHING MACHINE HAVING THE SAME

(75) Inventors: Sang-Hee Yoo, Gyeongsangnam-Do (KR); Jong-Deuk Bae, Gyeongsangnam-Do (KR); Bo-Young Chang, Gyeongsangnam-Do (KR); Young-Bae Park, Gyeongsangnam-Do (KR); Ji-Maeng Kim, Gyeongsangnam-Do (KR); Soo-Jin Jung, Gyeongsangnam-Do (KR); Ae-Na Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 513 days.

This patent is subject to a terminal disclaimer.

(21) Appl. No.: 12/041,823

(22) Filed: Mar. 4, 2008

(65) Prior Publication Data

US 2008/0216522 A1 Sep. 11, 2008

(30) Foreign Application Priority Data

Mar. 6, 2007 (KR) ..... 10-2007-0022176

(51) Int. Cl.
*D06F 39/10* (2006.01)

(52) U.S. Cl. ..... 68/18 F; 134/111

(58) Field of Classification Search ..... 68/18 F; 134/111

See application file for complete search history.

(56) References Cited

U.S. PATENT DOCUMENTS

| | | | | | |
|---|---|---|---|---|---|
| 7,981 | A | * | 3/1851 | Andrews | 16/445 |
| 2,413,954 | A | | 1/1947 | Conteman | |
| 2,586,508 | A | * | 2/1952 | Brotman | 210/437 |
| 2,936,604 | A | | 5/1960 | Glendening | |
| 2,939,305 | A | * | 6/1960 | Neidhart et al. | 68/18 F |
| 2,971,362 | A | | 2/1961 | Olding | |
| 3,027,742 | A | | 4/1962 | Nowicki | |
| 3,040,552 | A | * | 6/1962 | Platt et al. | 68/18 F |
| 3,240,345 | A | * | 3/1966 | Butler et al. | 210/435 |
| 3,361,261 | A | * | 1/1968 | Fairey et al. | 210/314 |
| 3,727,435 | A | | 4/1973 | Menk | |
| 3,769,818 | A | | 11/1973 | Smith | |

(Continued)

FOREIGN PATENT DOCUMENTS

DE 30 10 182 A1 10/1981

(Continued)

OTHER PUBLICATIONS

European Patent Office 0 735 179 Oct. 1996.*

*Primary Examiner* — Frankie L Stinson
(74) *Attorney, Agent, or Firm* — Birch, Stewart, Kolasch & Birch, LLP

(57) ABSTRACT

In a foreign materials filtering apparatus and a washing machine having the same, owing to a detachable mounting structure between a handle and a front filter and between a rear filter and the front filter, foreign materials collected in a foreign materials filtering space can be easily cleaned. Accordingly, can be solved the conventional problem that a net filter has to be kept inside out at the time of a cleaning process, resulting in causing a user's hands to become dirty. Also, can be solved the conventional problem that there is a difficulty in removing foreign materials from the net filter due to a fibrous characteristic of the net filter.

11 Claims, 8 Drawing Sheets

U.S. PATENT DOCUMENTS

| | | | | | |
|---|---|---|---|---|---|
| 3,805,404 | A | | 4/1974 | Gould | |
| 3,836,001 | A | | 9/1974 | Heldreth | |
| 3,891,548 | A | | 6/1975 | Marcussen | |
| 3,896,641 | A | | 7/1975 | Worst | |
| 3,910,076 | A | | 10/1975 | Ruble | |
| 3,977,219 | A | | 8/1976 | Bochan | |
| 4,081,975 | A | | 4/1978 | Wortham et al. | |
| 4,417,457 | A | | 11/1983 | Brenner | |
| 4,566,970 | A | | 1/1986 | Piai et al. | |
| 4,622,142 | A | * | 11/1986 | Teranishi | 210/238 |
| 4,833,900 | A | | 5/1989 | Babuin et al. | |
| 5,018,372 | A | | 5/1991 | Altnau, Sr. | |
| 5,078,862 | A | | 1/1992 | Justice | |
| 5,353,612 | A | | 10/1994 | Noguchi et al. | |
| 5,437,789 | A | | 8/1995 | Sabo et al. | |
| 5,509,283 | A | | 4/1996 | Lee et al. | |
| 5,618,419 | A | | 4/1997 | Fuerst | |
| 5,829,275 | A | | 11/1998 | Babuin et al. | |
| 5,849,182 | A | | 12/1998 | Shin | |
| 5,858,220 | A | | 1/1999 | Shin | |
| 5,863,423 | A | | 1/1999 | Shin et al. | |
| 5,931,027 | A | | 8/1999 | Shin | |
| 5,989,418 | A | * | 11/1999 | Shin | 210/167.01 |
| 6,076,378 | A | | 6/2000 | Shin | |
| 6,093,237 | A | * | 7/2000 | Keller et al. | 95/287 |
| 6,841,058 | B2 | | 1/2005 | Culvey et al. | |
| 7,267,289 | B2 | | 9/2007 | Lyons | |
| 7,412,853 | B2 | | 8/2008 | Hong et al. | |
| 2001/0010165 | A1 | | 8/2001 | Kubota et al. | |
| 2004/0159130 | A1 | | 8/2004 | Lee | |
| 2005/0000920 | A1 | | 1/2005 | Smolley | |
| 2005/0132759 | A1 | | 6/2005 | Guinibert et al. | |
| 2005/0246843 | A1 | | 11/2005 | Song et al. | |
| 2006/0075790 | A1 | | 4/2006 | Jeon et al. | |
| 2006/0096335 | A1 | | 5/2006 | Park et al. | |
| 2006/0123854 | A1 | | 6/2006 | Hong et al. | |
| 2006/0185403 | A1 | | 8/2006 | Ikemizu et al. | |
| 2008/0141554 | A1 | | 6/2008 | Bae et al. | |
| 2008/0141734 | A1 | | 6/2008 | Son et al. | |
| 2008/0216518 | A1 | | 9/2008 | Yoo et al. | |
| 2008/0216519 | A1 | | 9/2008 | Yoo et al. | |
| 2008/0216520 | A1 | | 9/2008 | Yoo et al. | |
| 2008/0216522 | A1 | | 9/2008 | Yoo et al. | |
| 2008/0216523 | A1 | | 9/2008 | Yoo et al. | |
| 2008/0217243 | A1 | | 9/2008 | Yoo et al. | |
| 2008/0276659 | A1 | | 11/2008 | Bae et al. | |
| 2008/0276661 | A1 | | 11/2008 | Bae et al. | |
| 2008/0302138 | A1 | | 12/2008 | Bae et al. | |
| 2008/0313922 | A1 | | 12/2008 | Bae et al. | |
| 2009/0078007 | A1 | | 3/2009 | Bae et al. | |
| 2009/0100882 | A1 | | 4/2009 | Bae et al. | |
| 2009/0113745 | A1 | | 5/2009 | Choi et al. | |
| 2009/0120140 | A1 | | 5/2009 | Choi et al. | |

FOREIGN PATENT DOCUMENTS

| | | | | |
|---|---|---|---|---|
| EP | 0 735 179 | A1 | | 10/1996 |
| JP | 01-131697 | | * | 5/1989 |
| JP | 02-005998 | | * | 1/1990 |
| JP | 2-114993 | A | | 4/1990 |
| JP | 06-319895 | | * | 11/1994 |
| JP | 08-323096 | | * | 12/1996 |
| JP | 09-299685 | | * | 11/1997 |
| JP | 10-000293 | | * | 1/1998 |
| JP | 11-207091 | A | | 8/1999 |
| JP | 2000-354697 | | * | 12/2000 |
| KR | 10-2001-0073573 | A | | 8/2001 |
| KR | 10-2002-0045381 | A | | 6/2002 |
| WO | WO 2005/118940 | A1 | | 12/2005 |

* cited by examiner

FOREIGN MATERIALS FILTERING APPARATUS AND WASHING MACHINE HAVING THE SAME

RELATED APPLICATION

The present invention relates to subject matter contained in priority Korean Application No. 10-2007-0022176, filed on Mar. 6, 2007, which is herein expressly incorporated by reference in its entirety.

BACKGROUND OF THE INVENTION

1. Field of the Invention

The present invention relates to a foreign materials filtering apparatus for filtering foreign materials such as nap floating in a washing tub, and a washing machine having the same, and more particularly, to a foreign materials filtering apparatus capable of easily cleaning foreign materials, and a washing machine having the same.

2. Description of the Background Art

Generally, a washing machine serves to remove each kind of foreign materials attached to laundry such as clothes and bedclothes by a softening operation using detergents, by a frictional operation using a washing current according to rotation of a pulsator, and by an impact applied to laundry from the pulsator, etc.

The washing machine comprises a cabinet that forms the appearance; a reservoir received in the cabinet; a washing tub received in the reservoir, and rotated at the time of a washing or dehydrating process; a motor installed at a bottom surface of the reservoir, for rotating a pulsator and the washing tub; and a clutch for determining a transmission direction of a driving force from the motor, such that both the pulsator and the washing tub rotate at the time of a washing operation, and only the washing tub rotates at the time of a dehydrating operation.

The washing machine further comprises a net filter installed at an inner side of the washing tub, for filtering foreign materials such as nap separated from laundry during a washing operation.

The operation of the net filter has been described in Korean Laid-Open Publication No. 2001-73573 or 2002-45381.

However, the conventional net filter has the following problems.

First of all, the net filter has to be kept inside out at the time of a cleaning process, which may cause a user's hands to become dirty.

Also, there is a difficulty in removing foreign materials from the net filter due to a fibrous characteristic of the net filter.

SUMMARY OF THE INVENTION

Therefore, it is an object of the present invention to provide a method for cleaning a foreign materials filtering apparatus capable of facilitating a cleaning operation.

To achieve these and other advantages and in accordance with the purpose of the present invention, as embodied and broadly described herein, there is also provided a foreign materials filtering apparatus, comprising: a filter cover unit; and a filter unit detachably mounted at the filter cover unit.

Preferably, the filter cover unit comprises a cap, and a handle detachably mounted at the cap.

Preferably, the filter unit comprises a front filter detachably mounted at the cap, and a rear filter detachably mounted at the front filter.

Preferably, the front filter comprises a front frame, and a front filter coupling portion coupled to the handle and the rear filter.

Preferably, the front filter coupling portion comprises coupling protrusions formed at the front frame, and inserted into coupling holes of the handle; coupling holes for inserting coupling protrusions of the rear filter; and hinge holes for inserting hinges of the rear filter.

Preferably, the rear filter comprises a rear frame, and a rear filter coupling portion formed at the rear frame and detachably coupled to the front filter.

Preferably, the rear filter coupling portion comprises coupling protrusions formed at the rear frame, and inserted into coupling holes of the front filter; and hinges inserted into hinge holes of the front filter.

To achieve these and other advantages and in accordance with the purpose of the present invention, as embodied and broadly described herein, there is also provided a washing machine, comprising: a cabinet; a reservoir received in the cabinet, for containing washing water therein; a washing tub rotatably installed in the reservoir; a pulsator installed at the washing tub, for stirring laundry; a washing water circulating duct that forms a flow passage through which washing water circulates as the pulsator rotates; and a filter cover unit detachably mounted at the washing water circulating duct, and a filter unit detachably installed at the filter cover unit.

Preferably, the filter cover unit comprises a cap, and a handle detachably installed at the cap. Preferably, hooks to be coupled to the washing water circulating duct are formed at the handle, and hook coupling grooves for coupling the hooks are formed at the washing water circulating duct.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
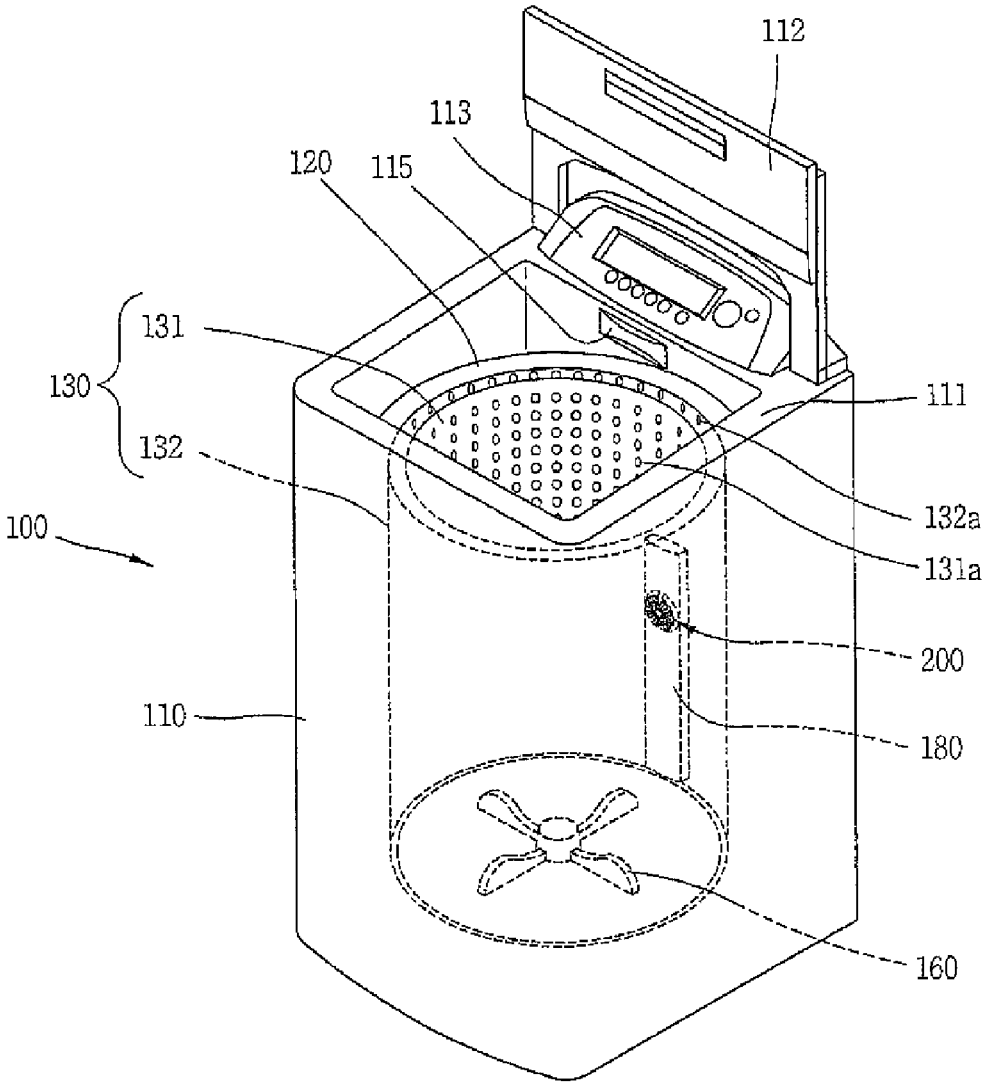
FIG. 1 is a perspective view of a washing machine having a foreign materials filtering apparatus according to a first embodiment of the present invention.
Figure 2:
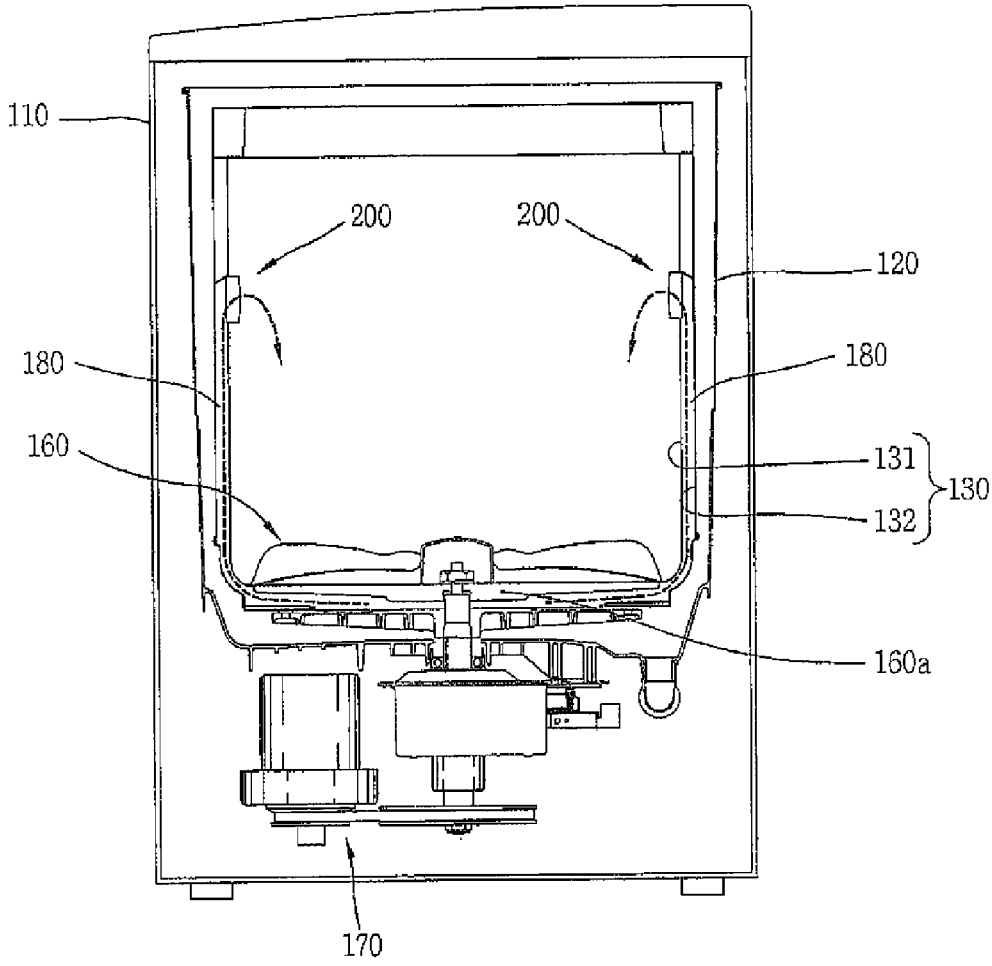
FIG. 2 is a side sectional view of the washing machine of FIG. 1.
Figure 3:
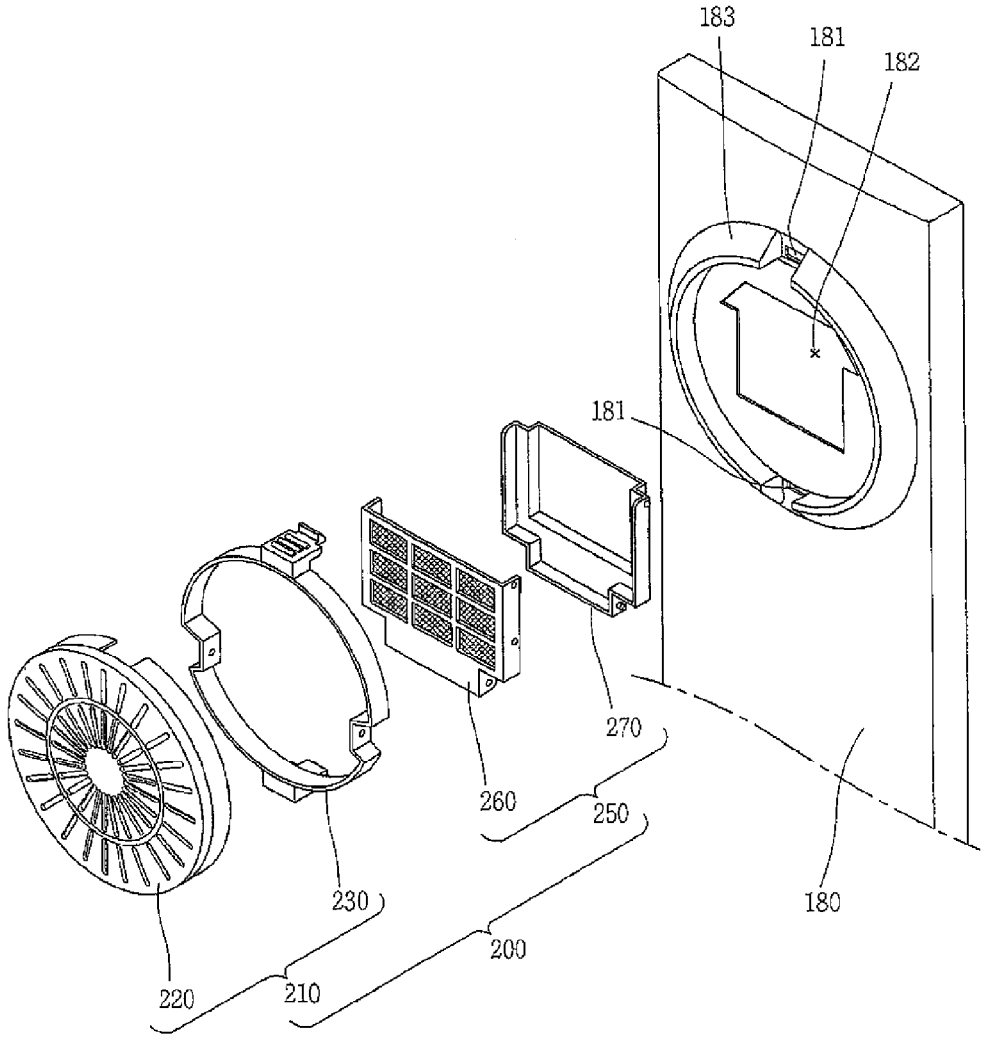
FIG. 3 is an exploded perspective view of the foreign materials filtering apparatus of FIG. 1.
Figure 4:
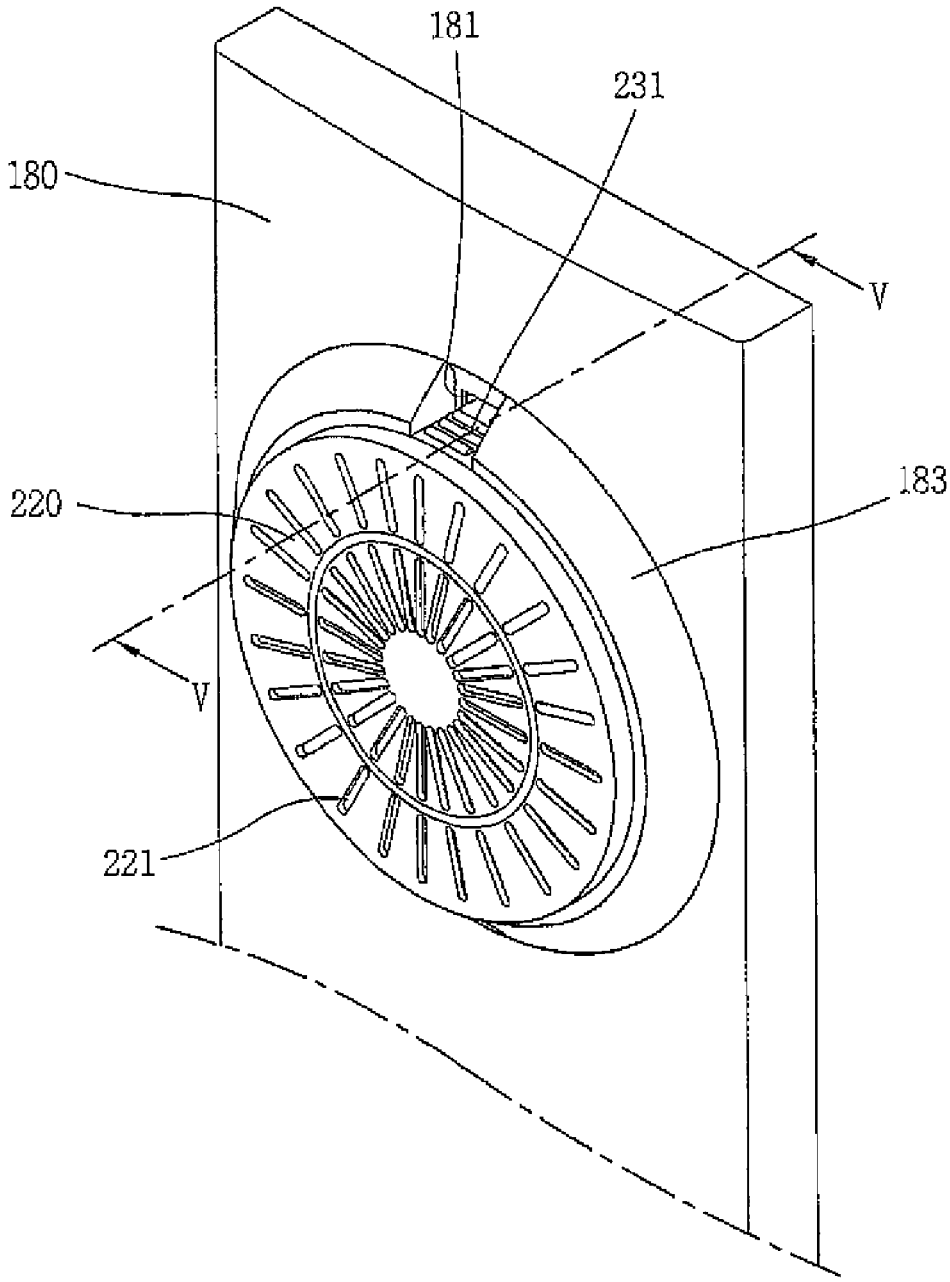
FIG. 4 is a perspective view showing a state that the foreign materials filtering apparatus of FIG. 1 is detachably mounted at a washing water circulating duct.
Figure 5:
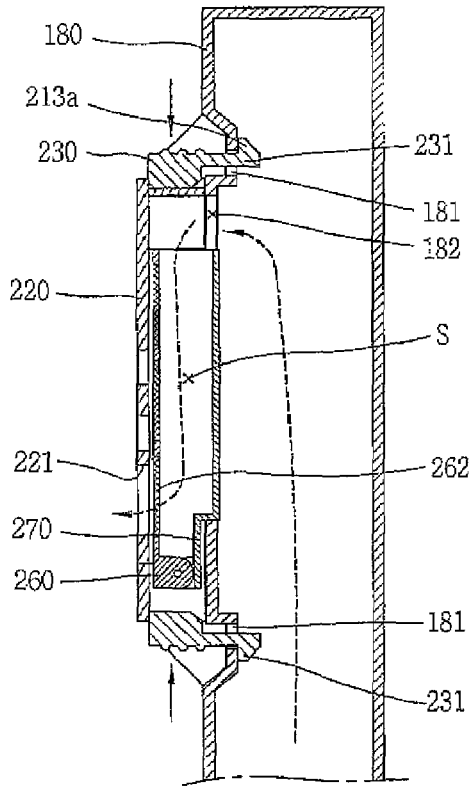
FIG. 5 is a sectional view taken along line 'V-V' of FIG. 4.
Figure 6:
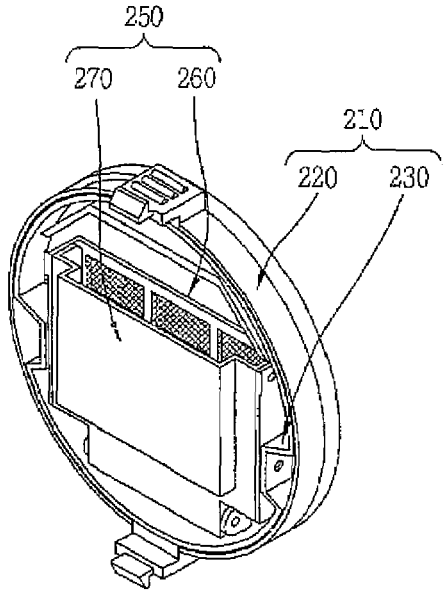
FIG. 6 is a disassembled rear view of the foreign materials filtering apparatus of FIG. 4.
Figure 7:
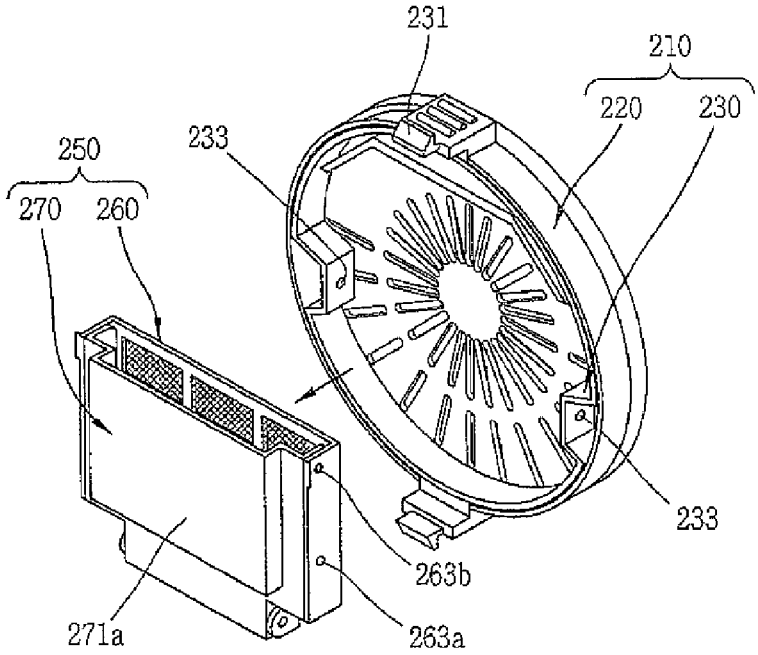
FIG. 7 is a view showing a state that a filter cover unit and a filter unit of FIG. 6 are separated from each other.
Figure 8:
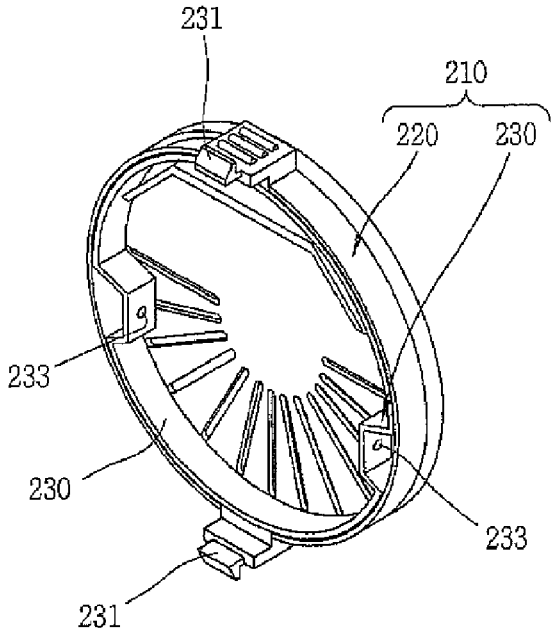
FIG. 8 is a view of the filter cover unit of FIG. 7.
Figure 9:
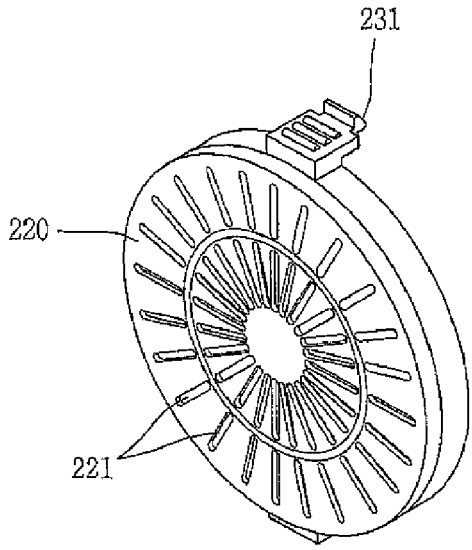
FIG. 9 is a perspective view of a cap of FIG. 8.
Figure 10:
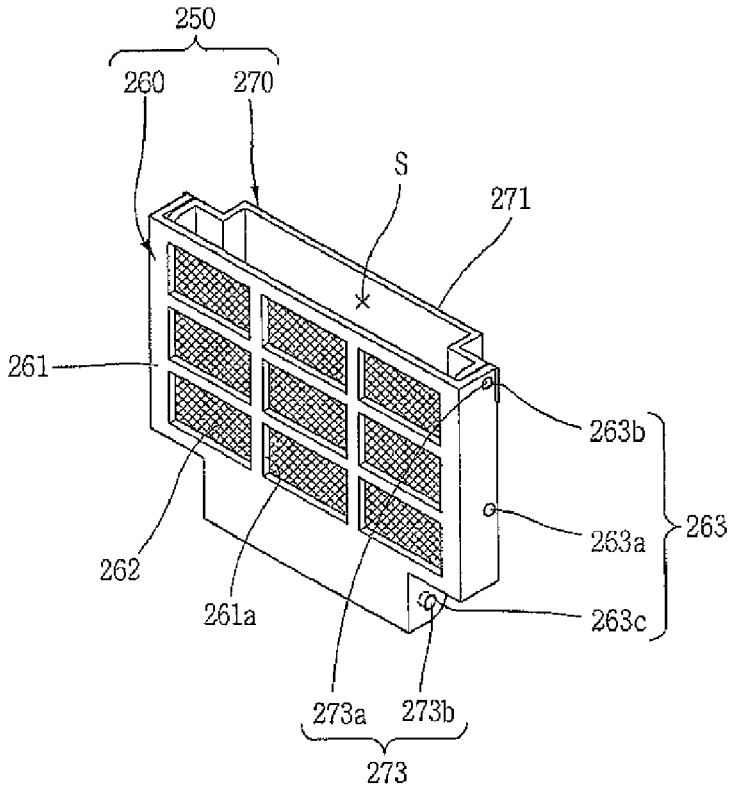
FIG. 10 is a view of the filter unit of FIG. 7.
Figure 11:
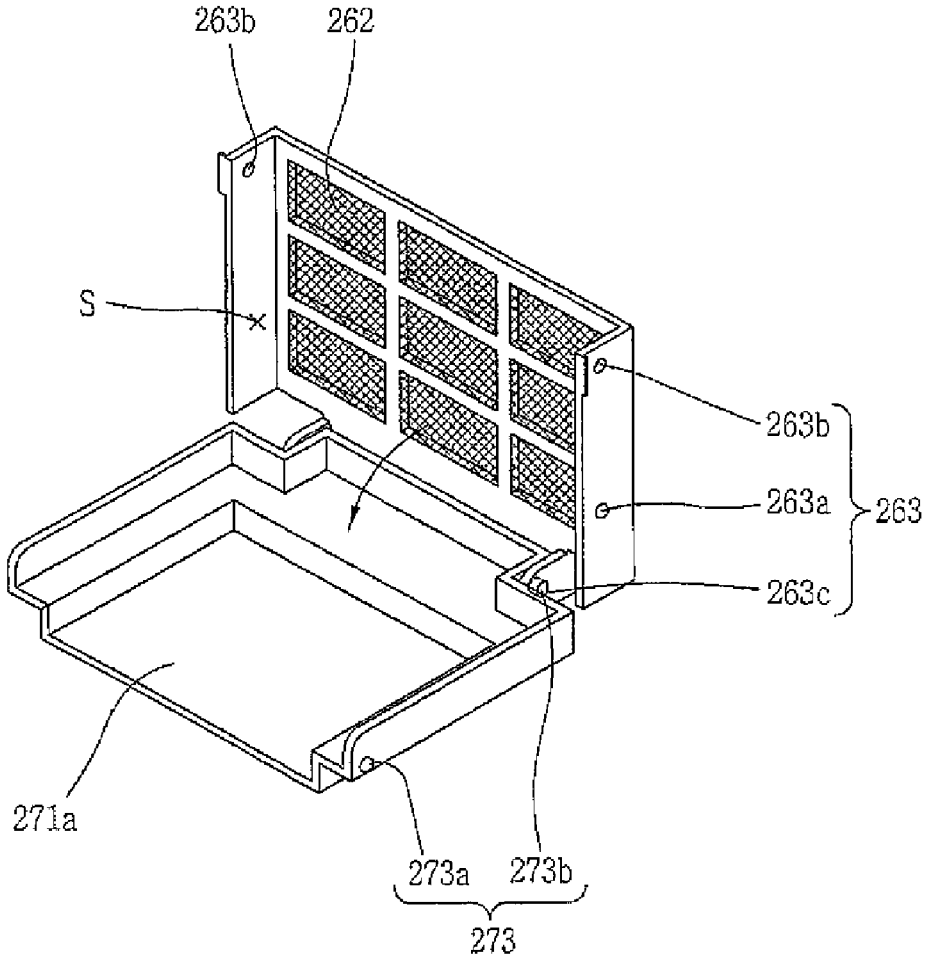
FIG. 11 is a view showing a state that a rear filter of FIG. 10 is backward opened.

FIG. 1 is a perspective view of a washing machine having a foreign materials filtering apparatus according to a first embodiment of the present invention, FIG. 2 is a side sectional view of the washing machine of FIG. 1, FIG. 3 is an exploded perspective view of the foreign materials filtering apparatus of FIG. 1, FIG. 4 is a perspective view showing a state that the foreign materials filtering apparatus of FIG. 1 is detachably mounted at a washing water circulating duct, FIG. 5 is a sectional view taken along line 'V-V' of FIG. 4, FIG. 6 is a disassembled rear view of the foreign materials filtering apparatus of FIG. 4, FIG. 7 is a view showing a state that a filter cover unit and a filter unit of FIG. 6 are separated from each other, FIG. 8 is a view of the filter cover unit of FIG. 7, FIG. 9 is a perspective view of a cap of FIG. 8, FIG. 10 is a view of the filter unit of FIG. 7, and FIG. 11 is a view showing a state that a rear filter of FIG. 10 is backward opened.

Referring to FIGS. 1 and 2, a washing machine 100 having a foreign materials filtering apparatus according to a first embodiment of the present invention comprises: a cabinet 110 that forms the appearance; a reservoir 120 received in the cabinet 110, for containing washing water therein; a washing tub 130 rotatably received in the reservoir 120, and consisting of an outer wall 132 and an inner wall 131; a pulsator 160 rotatably installed on a bottom surface of the inner wall 131, for stirring laundry; a driving unit 170 for simultaneously or individually driving the washing tub 130 and the pulsator 160; a washing water circulating duct 180 that forms a flow passage through which washing water rises toward an upper side of the washing tub 130 as the pulsator 160 rotates; and a foreign materials filtering apparatus 200 detachably mounted on the washing water circulating duct 180.

A top cover 111 is mounted at an upper portion of the cabinet 110. A lid 112 for opening and closing the washing tub 130 is installed at an upper portion of the top cover 111. A control panel 113 for controlling an operation of the washing machine 100 is installed at one side of the top cover 111, and a detergent box 115 is insertion-installed at an inner side of the top cover 111.

The washing tub 130 is composed of an outer wall 132 that forms the appearance, and an inner wall 131 spacing from the outer wall 132 with a certain gap and having a receiving space to receive laundry therein.

A plurality of drain holes 131*a* and 132*a* are penetratingly formed at the outer wall 132 and the inner wall 131, through which washing water inside the reservoir 120 flows in/out of the washing tub 130.

Referring to FIGS. 2 to 5, the washing water circulating duct 180 is formed between the outer wall 132 and the inner wall 131, and circulates washing water by guiding washing water collected below the pulsator 160 to an upper side of the washing tub 130 and then by flowing to the washing tub 130. A filter insertion hole 182 for mounting the foreign materials filtering apparatus 200 is formed at an intermediate portion of the washing water circulating duct 180. A guide protrusion 183 for covering a cap 220 of the foreign materials filtering apparatus 200 is protrudingly formed at the periphery of the filter insertion hole 182. Owing to the guide protrusion 183, the foreign materials filtering apparatus 200 can be stably mounted at a precise position of the washing water circulating duct 180.

Referring to FIGS. 6 and 7, the foreign materials filtering apparatus 200 includes a filter cover unit 210, and a filter unit 250 integrally detachably mounted at the filter cover unit 210.

Referring to FIGS. 8 and 9, the filter cover unit 210 includes a cap 220, and a handle 230 detachably mounted at the cap 220.

The cap 220 is a round-shaped lid, and is provided with a plurality of drain holes 221 radially arranged at a front lower end thereof. Through the drain holes 221, washing water having foreign materials removed therefrom is discharged to the washing tub 130.

The handle 230 has a ring shape of which central part inserted into the cap 220 is hollow. Hooks 231 to be coupled to hook coupling holes 181 of the washing water circulating duct 180 are formed at upper and lower portions of the handle 230. As a user separates the hooks 231 of the handle 230 from the hook coupling holes 181 with pressing the hooks 231 at both sides, the foreign materials filtering apparatus 200 is separated from the washing water circulating duct 180. Since the hooks 231 of the handle 230 are detachably mounted at the hook coupling holes 181 of the washing water circulating duct 180, the handle 230 can be easily detachably mounted at the washing water circulating duct 180. Since the foreign materials filtering apparatus 200 is easily detached from the washing water circulating duct 180, the foreign materials filtering space (S) filled with foreign materials can be easily cleaned.

Referring to FIGS. 10 and 11, the filter unit 250 includes a front filter 260 installed at a rear side of the cap 220, and a rear filter 270 installed at a rear side of the front filter 260. As the front and rear filters 260 and 270 are coupled to each other, a foreign materials filtering space (S) is formed.

The front filter 260 includes a front frame 261, and a front filter coupling portion 263 detachably coupled to the handle 230 and the rear filter 270.

A mesh 262 is formed at a front surface of the front frame 261, thereby filtering foreign materials included in washing water. The mesh 262 may be directly formed on the front surface of the frame 261 in an injection manner. As shown in the preferred embodiment, the mesh 262 may be formed by forming mesh mounting holes 261*a* on the front surface of the frame 261 and then by inserting a wire mesh into the mesh mounting holes 261*a*.

The front filter coupling portion 263 consists of coupling protrusions 263*a* formed at each intermediate part of both side surfaces of the front frame 261, coupling holes 263*b* formed at each upper end of both side surfaces of the front frame 261, and hinge holes 263*c* formed at each lower end of both side surfaces of the front frame 261.

The coupling protrusions 263*a* are inserted into coupling holes 233 (refer to FIG. 9) of the handle 230. Preferably, the coupling protrusions 263*a* are protruding with a height high enough to be easily detachably mounted at the coupling holes 233. It is also possible that the coupling protrusions 263*a* are formed at the handle 230, and the coupling holes 233 are formed at the front frame 261.

Coupling protrusions 273*a* of the rear filter 270 are inserted into the coupling holes 263*b*, and hinges 273*b* of the rear filter 270 are inserted into the hinge holes 263*c*.

As the coupling protrusions 263*a* are detachably mounted at the coupling holes 233, the front filter 260 can be easily detachably mounted at the handle 230. Accordingly, the filter unit 250 is easily detached from the filter cover unit 210, thereby easily cleaning the foreign materials filtering space (S) filled with foreign materials.

The rear filter 270 includes a rear frame 271, and a rear filter coupling portion 273 formed at the rear frame 271 and detachably coupled to the front filter 260.

The rear filter coupling portion 273 consists of coupling protrusions 273*a* formed at both side surfaces of the rear frame 271, and hinges 273*b* for rotating the rear frame 271 with respect to the front filter 260.

The coupling protrusions 273*a* are inserted into the coupling holes 263*b* of the front filter 260. Preferably, the coupling protrusions 273*a* are protruding with a height high enough to be easily detachably mounted at the coupling holes 263*b*. It is also possible that the coupling protrusions 273*a* are formed at the front filter 260, and the coupling holes 263*b* are formed at the rear filter 270. Owing to the detachable mounting structure between the coupling protrusions 273*a* and the coupling holes 263*b*, the rear filter 270 can be easily detachably mounted at the front filter 260.

The hinges 273*b* are inserted into the hinge holes 263*c* of the front filter 260. It is also possible that the hinges 273*b* are formed at the front filter 260, and the hinge holes 263*c* are formed at the rear filter 270.

Hereinafter, a process for cleaning the foreign materials filtering apparatus 200 will be explained with reference to FIG. 5.

First of all, the foreign materials filtering apparatus 200 is separated from the washing water circulating duct 180 under a state that the hooks 231 of the handle 230 are pressed in directions indicated by the arrows.

Referring to FIG. 7, the front filter 260 is pulled in a direction of the arrow so that the coupling protrusions 263*a* of the front filter 260 can be separated from the coupling holes 233 of the handle 230. As the coupling protrusions 263*a* of the front filter 260 are separated from the coupling holes 233 of the handle 230, the front and rear filters 260 and 270 are separated from the handle 230.

Referring to FIG. 11, the rear filer 270 is backward pulled so as to rotate centering around the hinges 273*b* in a direction of the arrow. Here, the coupling protrusions 273*a* of the rear filter 270 are backward opened while being separated from the coupling holes 263*b* of the front filter 260. Then, a user removes foreign materials collected in the foreign materials filtering space (S).

Owing to the detachable mounting structure between the handle 230 and the front filter 260 and between the rear filter 270 and the front filter 260, foreign materials collected in the foreign materials filtering space (S) can be easily cleaned.

As aforementioned, in the foreign materials filtering apparatus according to the present invention, owing to the detachable mounting structure between the handle and the front filter and between the rear filter and the front filter, foreign materials collected in the foreign materials filtering space can be easily cleaned. Accordingly, can be solved the conventional problem that the net filter has to be kept inside out at the time of a cleaning process, resulting in causing a user's hands to become dirty. Also, can be solved the conventional problem that there is a difficulty in removing foreign materials from the net filter due to a fibrous characteristic of the net filter.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A foreign materials filtering apparatus, comprising:
a filter cover unit having a cap and a handle detachably mounted at the cap; and
a filter unit detachably mounted at the filter cover unit, wherein the filter unit comprises:
a front filter detachably mounted at the cap; and
a rear filter detachably mounted at the front filter, wherein the front filter comprises:
a front frame; and
a front filter coupling portion formed at the front frame, and detachably coupled to the handle and the rear filter.

2. The apparatus of claim 1, wherein a mesh is formed at the front frame.

3. The apparatus of claim 2, wherein the mesh is integrally formed at the front frame.

4. The apparatus of claim 2, wherein the mesh is a wire mesh installed at a mesh mounting hole formed at the front frame.

5. The apparatus of claim 4, wherein the wire mesh is insertion-installed at the mesh mounting hole.

6. The apparatus of claim 1, wherein the front filter coupling portion comprises:
coupling protrusions formed at the front frame, and inserted into coupling holes of the handle;
coupling holes for inserting coupling protrusions of the rear filter; and
hinge holes for inserting hinges of the rear filter.

7. The apparatus of claim 1, wherein the rear filter comprises:
a rear frame; and
a rear filter coupling portion formed at the rear frame and detachably coupled to the front filter.

8. A foreign materials filtering apparatus, comprising:
a filter cover unit having a cap and a handle detachably mounted at the cap; and
a filter unit detachably mounted at the filter cover unit, wherein the filter unit comprises:
a front filter detachably mounted at the cap; and
a rear filter detachably mounted at the front filter, wherein the rear filter comprises:
a rear frame; and
a rear filter coupling portion formed at the rear frame and detachably coupled to the front filter, and
wherein the rear filter coupling portion comprises:
coupling protrusions formed at the rear frame, and inserted into coupling holes of the front filter; and
hinges inserted into hinge hole of the front filter.

9. The apparatus of claim 8, wherein the rear filter is backward opened while counterclockwise rotating centering around the hinge hole.

10. A washing machine, comprising:
a cabinet;
a reservoir received in the cabinet, for containing washing water therein;
a washing tub rotatably installed in the reservoir;

a pulsator installed at the washing tub, for stirring laundry;

a washing water circulating duct that forms a flow passage through which washing water circulates as the pulsator rotates;

a filter cover unit detachably mounted at the washing water circulating duct and having a cap and a handle detachably installed at the cap; and a filter unit detachably installed at the filter cover unit, wherein the filter unit comprises:

a front filter detachably mounted at the cap; and a rear filter detachably mounted at the front filter.

11. The washing machine of claim 10, wherein hooks to be coupled to the washing water circulating duct are formed at the handle, and hook coupling grooves for coupling the hooks are formed at the washing water circulating duct.

* * * * *